US006064301A

United States Patent [19]

Takahashi et al.

[11] Patent Number: 6,064,301

[45] Date of Patent: May 16, 2000

[54] ROADWAY DEVIATION PREVENTION SYSTEM

[75] Inventors: Masashi Takahashi; Hiroshi Takada, both of Tokyo, Japan

[73] Assignee: Oki Electric Industry Co., Ltd., Tokyo, Japan

[21] Appl. No.: 09/246,146

[22] Filed: Feb. 8, 1999

[30] Foreign Application Priority Data

Feb. 10, 1998 [JP] Japan ..... 10-028265

[51] Int. Cl.[7] ..... G60Q 1/00

[52] U.S. Cl. ..... 340/435; 340/438; 340/904; 340/905; 340/933; 340/935

[58] Field of Search ..... 340/435, 438, 340/901, 904, 905, 933, 935, 936, 938, 941, 939

[56] References Cited

U.S. PATENT DOCUMENTS

| | | | |
|---|---|---|---|
| 4,348,652 | 9/1982 | Barnes et al. | 340/52 R |
| 4,630,044 | 12/1986 | Polzer | 340/825.72 |
| 5,039,979 | 8/1991 | McClive | 340/438 |
| 5,268,692 | 12/1993 | Grosch et al. | 342/70 |
| 5,318,143 | 6/1994 | Parker et al. | 180/168 |
| 5,355,137 | 10/1994 | Schurmann | 342/42 |
| 5,434,781 | 7/1995 | Alofs et al. | 364/424.02 |
| 5,568,137 | 10/1996 | Liu | 340/905 |
| 5,708,427 | 1/1998 | Bush | 340/941 |

*Primary Examiner*—Daniel J. Wu
*Assistant Examiner*—Tai T. Nguyen
*Attorney, Agent, or Firm*—Rabin & Champagne, P.C.

[57] ABSTRACT

A roadway deviation prevention system prevents a vehicle from deviating from the roadway. This roadway deviation prevention system has an on-vehicle transceiver which transmits a vehicle presence signal having a prescribed frequency, and data carriers, which are installed on a road, for emitting a warning signal resonating with the vehicle presence signal when the vehicle comes close to the data carriers. The on-vehicle transceiver has an annunciator which generates an alarm sound to inform the presence of the data carriers to the driver of the vehicle based on an induced voltage generated in the transceiver unit by the electromagnetic induction of the warning signal. The data carrier emits the warning signal based only on the energy generated when the resonance circuit receives the vehicle presence signal. Thus, this data carrier operates with no power source.

20 Claims, 6 Drawing Sheets

ROADWAY DEVIATION PREVENTION SYSTEM

This patent application claims priority based on a Japanese patent application, H10-028265 filed on Feb. 10, 1998, the contents of which are incorporated herein by reference.

BACKGROUND OF THE INVENTION

1. Field of the Invention

The present invention relates to a roadway deviation prevention system which prevents vehicles from deviating from the roadway.

2. Description of Related Art

Conventionally, the driver of a vehicle had to identify the position of the vehicle by observing the distance between the vehicle and the center line marked on the road or the distance between the vehicle and the side line marked on the road.

In addition, construction and maintenance traffic control signs, channeling devices such as barricades, drums, cones, and vertical panels, and flashing arrow panels or the like are installed around off limits areas on roadways such as road construction and maintenance work areas to direct drivers.

However, the visibility of the center line, side line, construction and maintenance traffic control signs, channeling devices such as barricades, drums, cones, and vertical panels, and flashing arrow panels or the like deteriorates when the roadway is covered with dirt or snow, or when rain or fog falls, or at night, or near the sunset when the sun light is weak but not all the vehicles start to use the head lights. Under these conditions, it is difficult to maintain safe traffic conditions.

Forming easily recognizable bumps on a portion of the roadway nearby the roadside is an effective method to show drivers the position of the edge of road. However, such bumps are buried under snow during snow season in areas where heavy snow falls often. In addition, during snow season, construction and maintenance traffic control signs, channeling devices such as barricades, drums, cones, and vertical panels, flashing arrow panels, and DETOUR sign or the like indicating the presence of off limits areas are not clearly identifiable for drivers in areas where heavy snow falls often.

Moreover, driving long hours may make a driver drowsy or unaware of what is happening due to fatigue, in which case the vehicle can deviate from the roadway and an accident may be caused.

SUMMARY OF THE INVENTION

Given these problems, it is an object of the present invention to provide a roadway deviation prevention system capable of solving these problems. In other words, the present invention aims to provide a maintenance-free roadway deviation prevention system capable of accurately detecting the presence of off limits areas without being influenced by poor visibility caused by bad weathers, dirt covering the roadway, or night time, and capable of informing the drivers of the presence and position of the off limits areas. This object is achieved by a combination of features described in the independent claims of the present invention. Moreover, the dependent claims of the present invention determine further advantageous embodiments of the present invention.

In order to solve the above-stated problems, according to a first aspect of the present invention, an on-vehicle transceiver for transmitting to data carriers installed in a road a vehicle presence signal for indicating the presence of the vehicle is provided. This on-vehicle transceiver has an oscillator unit for generating the vehicle presence signal and a transceiver unit which transmits the vehicle presence signal generated by the oscillator unit to the data carriers and receives a warning signal for indicating presence of the data carriers that is transmitted from the data carriers based on the vehicle presence signal. As a result of this configuration of the on-vehicle transceiver, the driver of the vehicle is able to identify the presence of the data carriers installed in the road.

According to a mode of the first aspect of the present invention, the on-vehicle transceiver further has an annunciator which informs the presence of the data carriers to the driver of the vehicle based on an induced voltage generated in the transceiver unit by the electromagnetic induction of the warning signal.

According to another mode of the first aspect of the present invention, the annunciator outputs an alarm sound based on the induced voltage.

According to still another mode of the first aspect of the present invention, the on-vehicle transceiver further has a detector unit which detects a circuit voltage generated in the transceiver unit based on the induced voltage, and the annunciator outputs the alarm sound based on the circuit voltage detected by the detector unit.

According to a further mode of the first aspect of the present invention, the detector unit has a differential amplifier which amplifies and outputs the voltage difference between the circuit voltage generated in the transceiver unit and a prescribed reference voltage, and the annunicator outputs the alarm sound based on the voltage difference output from the differential amplifier.

According to still further mode of the first aspect of the present invention, the annunciator outputs the alarm sound having a level that corresponds to the voltage difference.

According to another mode of the first aspect of the present invention, the on-vehicle transceiver further has a speed detector unit for detecting the speed of the vehicle, and the annunicator is turned off when the speed detector unit detects that the speed of the vehicle is below a prescribed speed.

In order to solve the above-stated problems, according to a second aspect of the present invention, an on-vehicle transceiver for transmitting to data carriers installed in a road a vehicle presence signal for indicating the presence of a vehicle is provided. This on-vehicle transceiver has an oscillator unit for generating the vehicle presence signal, a transmitter unit which transmits the vehicle presence signal generated by the oscillator unit to the data carriers, and a receiver unit which receives a warning signal for indicating presence of the data carriers that is transmitted from the data carriers based on the vehicle presence signal. The transmitter unit and receiver unit of this on-vehicle transceiver can be installed separately. Hence, a general purpose roadway deviation prevention system can be constructed.

In order to solve the above-stated problems, according to a third aspect of the present invention, a data carrier to be embedded in a road is provided. This data carrier informs the on-vehicle transceiver unit installed on the vehicle of the presence of the data carrier. Specifically, this data carrier has a resonance circuit having a capacitor and a coil. The resonance circuit resonates with a vehicle presence signal for indicating presence of the vehicle transmitted from the on-vehicle transceiver unit when the vehicle approaches close to the data carrier and emits a warning signal which indicates the presence of the data carrier. Together with the afore-mentioned on-vehicle transceiver, this data carrier can constitute a roadway deviation prevention system that provides safety to the driver.

According to a mode of the third aspect of the present invention, the data carrier emits the warning signal based only on energy generated when the resonance circuit receives the vehicle presence signal. That is, this data carrier operates with no power source.

According to another mode of the third aspect of the present invention, the data carrier further has a storage capacitor for storing power generated when the resonance circuit receives the vehicle presence signal, and a switch which turns on or shuts off the resonance circuit based on the power stored in the storage capacitor.

According to a further mode of the third aspect of the present invention, the switch periodically turns on or shuts off the resonance circuit.

In order to solve the above-stated problems, according to a fourth aspect of the present invention, a vehicle having an on-vehicle transceiver which transmits a vehicle presence signal is provided for indicating the presence of the vehicle to data carriers embedded in a road. This on-vehicle transceiver unit has an oscillator unit for generating the vehicle presence signal, a transmitter unit that transmits to the data carriers the vehicle presence signal generated by the oscillator unit, and a receiver unit that receives a warning signal that is transmitted from the data carriers based on the vehicle presence signal for indicating presence of the data carriers. The transmitter unit and the receiver unit may be constructed as separate units or may constitute a single transceiver unit. When the transmitter unit and the receiver unit constitute a single transceiver unit, an antenna is installed on this on-vehicle transceiver.

According to a mode of the fourth aspect of the present invention, the on-vehicle transceiver may be installed in a center portion of the width of the vehicle.

According to another mode of the fourth aspect of the present invention, the on-vehicle transceiver may be installed on a side portion of the vehicle.

In order to solve the above-stated problems, according to a fifth aspect of the present invention, a roadway deviation prevention system is provided for preventing a vehicle from deviating from a roadway. This roadway deviation prevention system has an on-vehicle transceiver that transmits a vehicle presence signal having a prescribed frequency, and data carriers, which are installed on a road, for emitting a warning signal resonating with the vehicle presence signal when the vehicle comes close to the data carriers. By installing this roadway deviation prevention system on the road, it becomes possible to prevent a deviation of the vehicle from the roadway, which might otherwise occur when the driver is not alert or when the weather is bad.

According to a mode of the fifth aspect of the present invention, the on-vehicle transceiver has an annunciator which informs the driver of the vehicle of the presence of the data carriers based on the warning signal.

According to another mode of the fifth aspect of the present invention, the on-vehicle transceiver has a receiver unit for receiving the warning signal, and the annunciator informs the driver of the vehicle of the presence of the data carriers based on the induced voltage generated in the receiving unit by the electromagnetic induction of the warning signal.

According to a further mode of the fifth aspect of the present invention, the annunciator outputs an alarm sound based on the induced voltage.

According to a still further mode of the fifth aspect of the present invention, the data carriers are periodically embedded in said road.

According to another mode of the fifth aspect of the present invention, the data carriers are periodically embedded in a roadside in a first row and a second row parallel to the traveling direction of the vehicle. The data carriers in the first row are arranged with a first prescribed separation distance, and the data carriers in the second row are arranged with a second prescribed separation distance that is shorter than the first prescribed separation distance.

It should be noted here that the above summary of the invention does not list all the characteristics of the present invention. Sub combinations of these characteristics are also included in the technical range of application of the present invention.

BRIEF DESCRIPTION OF THE DRAWINGS

FIG. 6(*b*) shows the relation between the circuit voltage and the prescribe reference voltage Vref during dangerous driving.

FIG. 10(*b*) shows a voltage change detected by the on-vehicle transceiver based on a warning signal transmitted from data carriers embedded densely under the far roadside of the highway.

DETAILED DESCRIPTION OF THE INVENTION

In what follows, the present invention will be explained with embodiments. However, the following embodiments do not restrict the scope of the invention described in the claims. Moreover, not all the combinations of the characteristics of the present invention described in the embodiments are essential to the problem solving means by the present invention.

Figure 1:
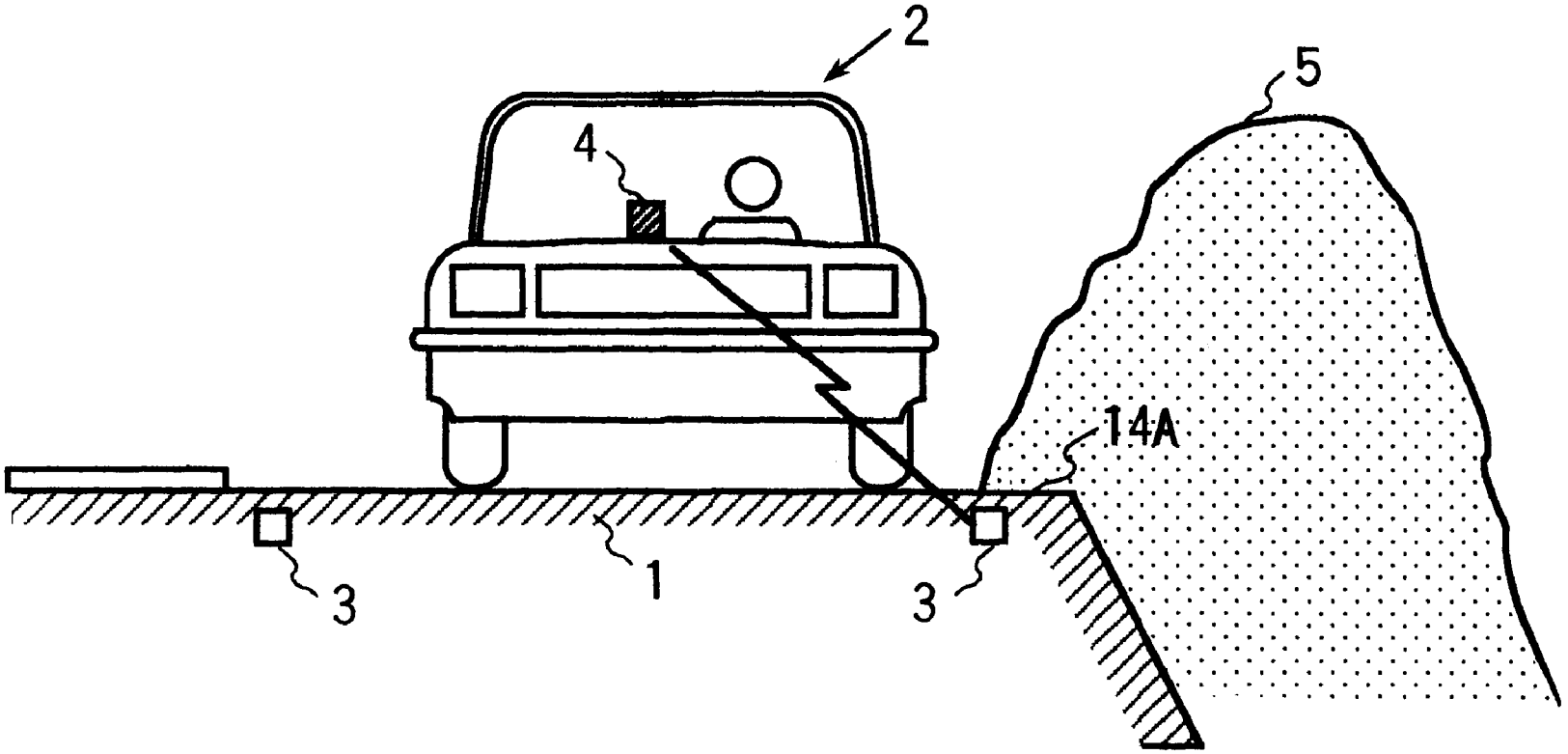
FIG. 1 is a schematic drawing of the on-roadway vehicle deviation prevention system according to the first embodiment of the present invention.

FIG. 1 is a schematic drawing of the roadway deviation prevention system according to the first embodiment of the present invention. In FIG. 1, a vehicle 2 is traveling on a road 1. Snow 5 is piled up on the edge of the road 1. Therefore, the driver of the vehicle 1 cannot identify the shoulder 1A of the road 1. An on-vehicle transceiver 4 is installed on the vehicle 2. Data carriers 3 are embedded in the road 1 in such a manner that the surface of each of the data carriers 3 will be exposed so that radio waves can be easily transmitted and received. In the present specification, the term "road" refers to any roadway, sidewalk, roadside, road shoulder, or the like.

The on-vehicle transceiver 4 transmits a vehicle presence signal which indicates the presence of the vehicle 2. When the vehicle 2 approaches close to the data carrier 3, the data carrier 3 receives the vehicle presence signal, resonates with the received vehicle presence signal, and emits a warning signal in response to the vehicle presence signal to indicate the presence of the data carrier 3 near the vehicle 2. The data carrier 3 emits the warning signal based only on the energy generated by the received vehicle presence signal. The on-vehicle transceiver 4 receives the warning signal and then informs the driver of the presence of the data carrier 3. The driver then recognizes that the vehicle is in danger of deviating from the roadway, and adjusts the traveling direction of the vehicle 2.

Figure 2:
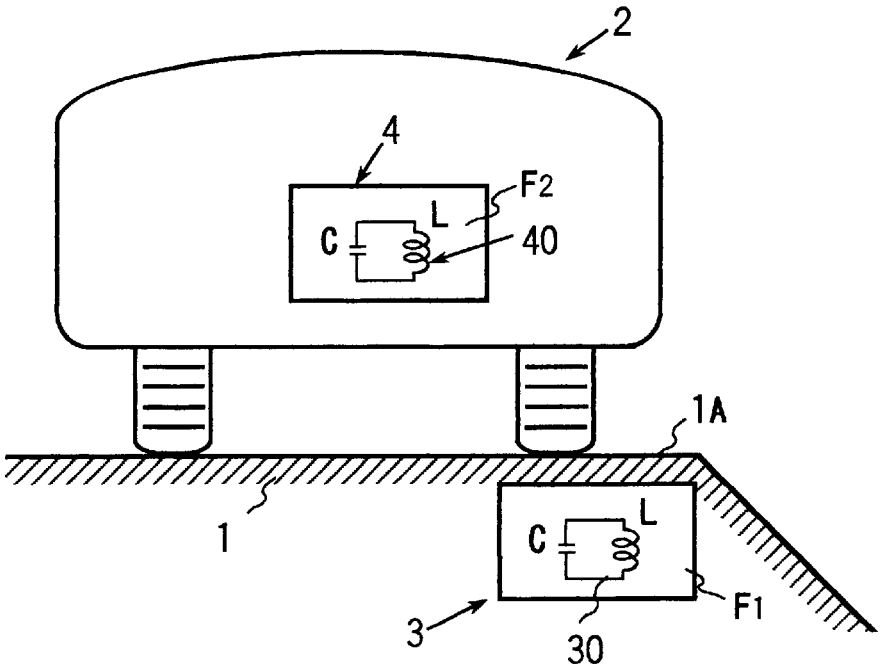
FIG. 2 is a schematic drawing showing the configuration of the on-roadway vehicle deviation prevention system according to the first embodiment of the present invention.

FIG. 2 is a schematic drawing showing the configuration of the on-roadway vehicle deviation prevention system according to the first embodiment of the present invention. In the same manner as what is shown in FIG. 1, an on-vehicle transceiver 4 is installed on a vehicle 2, and data carriers 3 are embedded in a road 1. In FIG. 2, the data carriers 3 are embedded in the road shoulder 1A of the road 1. However, in another embodiment of the present invention, the data carriers 3 may be embedded in any of the road shoulder, a sidewalk, the roadway, or the like, of the road 1. Moreover, the data carriers 3 may be embedded not only in the road 1. The data carriers 3 may also be installed on a pole installed along the road 1. Furthermore, as shown in FIG. 2, it is desirable that the on-vehicle transceiver 4 be installed in the central portion of the width of the vehicle 2. However in another embodiment of the present invention, the installation position of the on-vehicle transceiver 4 may be changed appropriately in accordance with the positions at which of the data carriers 3 are embedded in the road 1. For example, when the data carriers 3*a* are installed in the road shoulder 1A as shown in FIG. 2, the on-vehicle transceiver 4 may be installed on the side portion of the vehicle 2 that is closest to the roadside or on both side portions of the vehicle 2.

Each of the data carriers 3 has a resonance circuit 30. The resonance circuit 30 has a capacitor C and a coil L. The resonance frequency $F_1$ of the resonance circuit 30 is set to, for example, 100 kHz. Since these data carriers 3 operate with no power source, they require no maintenance after they are installed. The on-vehicle transceiver 4 has a transceiver unit 40 having a capacitor C and a coil L like the resonance circuit 30. The transceiver unit 40 emits a vehicle presence signal, and receives warning signals emitted from the data carriers 3. The oscillation frequency $F_2$of the transceiver unit 40 is set equal to the resonance frequency $F_1$ of the resonance circuit 30.

Figure 3:
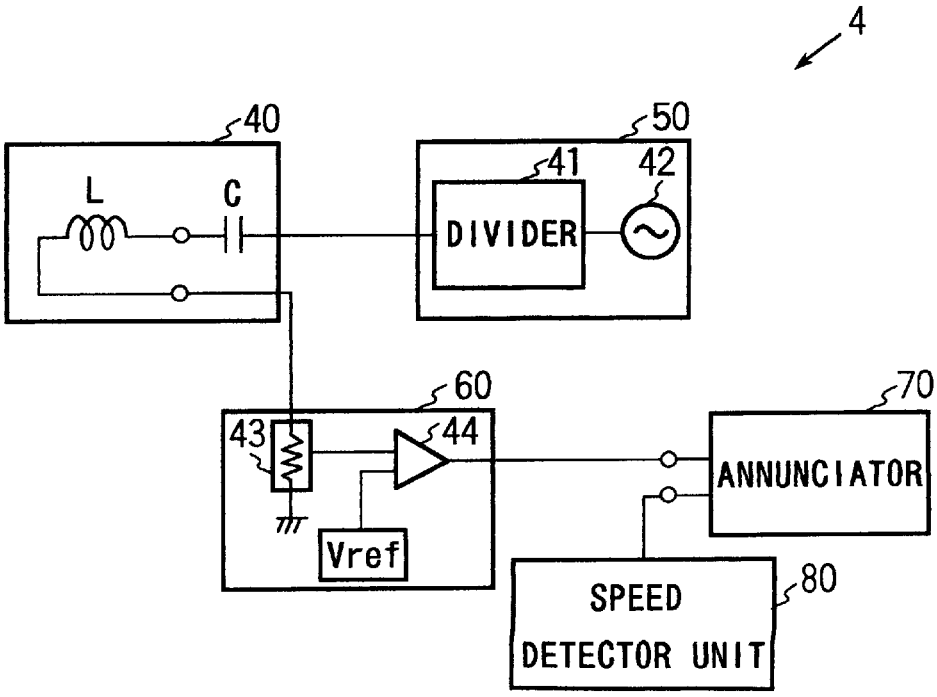
FIG. 3 shows an exemplary circuit configuration of an on-vehicle transceiver installed on a vehicle in the first embodiment of the present invention.

FIG. 3 shows an exemplary circuit configuration of the on-vehicle transceiver 4 installed on the vehicle 2 in the first embodiment of the present invention. The on-vehicle transceiver 4 has a transceiver unit 40, an oscillator unit 50, a detector unit 60, an annunciator 70, and a speed detector unit 80. The transceiver unit 40 has an LC circuit for transmitting a vehicle presence signal and receiving a warning signal. In this embodiment, the transceiver unit 40 transmits a vehicle presence signal and receives a warning signal. However in another embodiment, a transmission unit for transmitting a vehicle presence signal and a receiving unit for receiving a warning signal may be installed separately. One end of the transceiver unit 40 is connected to the oscillator unit 50. The other end of the transceiver unit 40 is connected to the detector unit 60. The oscillator unit 50 has a resonator 42 as an oscillation source and a divider 41. The detector unit 60 has a variable resistance device 43 and a differential amplifier 44.

The operation of each of these components will be explained in the case in which the transceiver unit 40 transmits a vehicle presence signal, which indicates that the vehicle 2 is present, to the data carriers 3. First, the oscillator unit as an oscillation source generates a vehicle presence signal having a high frequency. The divider 41 divides the frequency of the vehicle presence signal so that the oscillation frequency $F_2$of the vehicle presence signal will be equal to the resonance frequency $F_1$of the resonance circuit 30. The transceiver unit 40 receives the output of the divider 41 and transmits a vehicle presence signal having a prescribed frequency, for example, 100 kHz, to the resonance circuit 30 of the data carrier 3.

Next, the operation of each of these components will be explained in the case in which the transceiver unit 40 receives a warning signal from the resonance circuit 30 of the data carrier 3. When the transceiver unit 40 receives a warning signal from the resonance circuit 30 of the data carrier 3, a voltage is induced in the transceiver unit 40 by the electromagnetic induction of the warning signal. This induced voltage changes the circuit voltage generated in the transceiver unit 40.

In other words, when a vehicle 2 having the on-vehicle transceiver unit 4 approaches close to the data carrier 3, the transceiver unit 40 is coupled with the resonance circuit 30 by the electromagnetic induction. As a result, the inductance of the transceiver unit 40 changes, which causes the circuit voltage of the transceiver unit 40 to change. When the transceiver unit 40 is strongly coupled with the resonance circuit 30 by the electromagnetic induction, the inductance of the transceiver unit 40 decreases, and the circuit voltage of the transceiver unit 40 increases. The detector unit 60 detects the circuit voltage of the transceiver unit 40 and outputs the difference between the detected circuit voltage of the transceiver unit 40 and a prescribed reference voltage Vref.

In this embodiment, the circuit voltage of the transceiver unit 40 is divided by the variable resistance device 43, and is input to one input terminal of the differential amplifier 44. The prescribed reference voltage Vref is input to the other input terminal of the differential amplifier 44. The differential amplifier 44 amplifies the voltage difference between the divided circuit voltage of the transceiver unit 40 and the reference voltage Vref, and outputs the amplified voltage difference to the annunciator 70. In this case, the variable resistance device 43 divides the circuit voltage of the transceiver unit 40 based on the levels of the circuit voltage and reference voltage Vref.

When the radio wave reception sensitivity of the on-vehicle transceiver 4 varies depending on the installation position on the vehicle 2, the variable resistance device 43 is adjusted so that the circuit voltage can be properly adjusted with respect to the level of the reference voltage Vref. When the variable resistance device 43 is not used, the reference voltage Vref is adjusted with respect to the level of the circuit voltage so that the differential amplifier 44 can output an appropriate voltage difference.

The annunciator 70 receives the output of the differential amplifier 44, and informs the driver of the presence of the data carrier 3. For example, the annunciator 70 informs the driver of the presence of the data carrier 3 by generating an alarm sound. The driver hears the alarm sound output from the annunciator 70, and then recognizes that the vehicle 2 is approaching close to the data carrier 3, that is, the vehicle 2 is approaching close to the road shoulder 1A and is about to deviate from the roadway. The driver then adjusts the direction of the vehicle 2 to prevent the vehicle 2 from deviating from the roadway.

Moreover, the annunciator 70 may generate an alarm sound whose level corresponds to the voltage difference output from the differential amplifier 44. This variation of the present embodiment will be discussed later with reference to FIG. 7.

When the driver stops the vehicle on the roadside, the driver is aware of the position of the vehicle 2 with respect to the roadside. Therefore, there is no need for the annunciator 70 to generate an alarm sound. When the driver is driving the vehicle 2 slowly also, there is usually no need for the annunciator 70 to generate an alarm sound since the driver is aware of the position of the vehicle 2 with respect to the roadside. Therefore, the annunciator 70 may be turned off in such cases.

Hence, the speed detector unit 80 detects the speed of the vehicle 2. When the speed detector unit 80 detects that the speed of the vehicle 2 is below a prescribed speed, the speed detector unit 80 outputs to the annunciator 70 a stop signal for stopping the operation of the annunciator 70. This prescribed speed can be set to any value, for example, 15 mph. When the annunciator 70 receives the stop signal, the annunciator 70 stops outputting the alarm sound.

Figure 4:
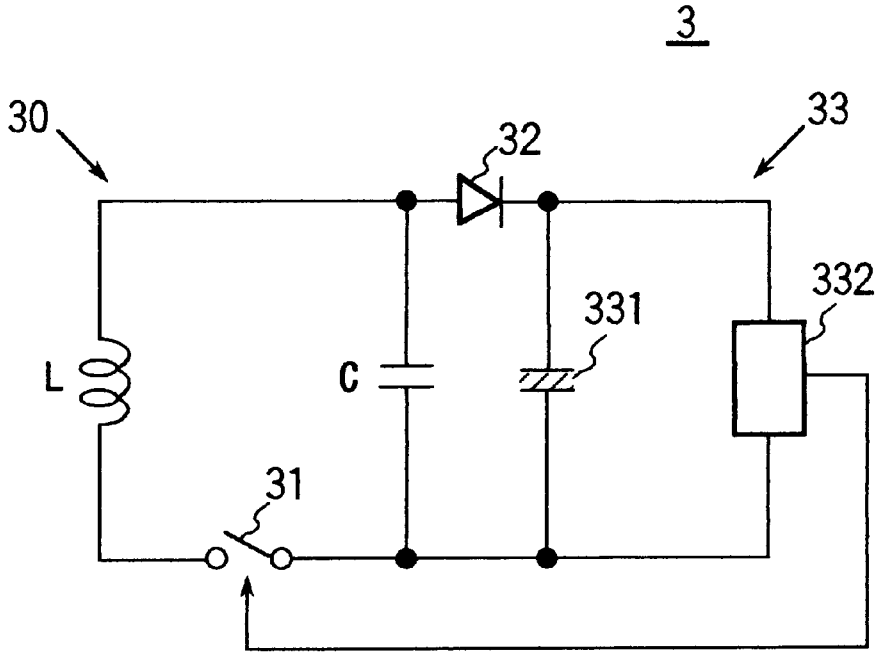
FIG. 4 shows an exemplary circuit configuration of a data carrier embedded in the road in the first embodiment of the present invention.

FIG. 4 shows an exemplary circuit configuration of the data carrier 3 to be embedded in the road in the first embodiment of the present invention. This data carrier 3 has a resonance circuit 30, a switch 31, a diode 32, and a switch driver unit 33. The resonance circuit 30 has a capacitor C and a coil L. The switch driver unit 33 has a parallel circuit having a storage electrolytic capacitor 331 and an oscillation circuit 332 which operates using this storage electrolytic capacitor 331 as a power source. The switch driver unit 33 drives the switch 31 so as to turn on or off the resonance circuit 30.

The voltage change in the transceiver unit 40, which is caused by the electromagnetic induction when the transceiver unit 40 is coupled with the resonance circuit 30, is influenced by the speed of the vehicle 2. That is, the voltage of the transceiver unit 40 changes slowly when the speed of the vehicle 2 is low. In this case, the slopes of the rise and fall of the voltage are relatively small. On the other hand, the voltage of the transceiver unit 40 changes rapidly when the speed of the vehicle 2 is high. In this case, the slopes of the rise and fall of the voltage are relatively large. When the speed of the vehicle 2 is low, the voltage change generated in the transceiver unit 40 by the electromagnetic induction is small, in which case, it can become difficult to identify the presence of the data carrier 3.

Thus, the waveform of the voltage change in the transceiver unit 40 is influenced by the speed of the vehicle 2. However, the data carrier 3 shown in FIG. 4 is able to resonate periodically regardless of the speed of the vehicle 2. A voltage is generated in the resonance circuit 30 by the electromagnetic induction of the transceiver unit 40 of the vehicle 2. This voltage is stored in the storage electrolytic capacitor 331. The oscillation circuit 332 oscillates driven by the voltage stored in the storage electrolytic capacitor 331. Based on the output of the oscillation circuit 332, the switch turns on or off the resonance circuit 30 with a prescribed time interval. Therefore, the data carrier 3 outputs a pulse wave having a prescribed period regardless of the speed of the vehicle 2.

Figure 5:
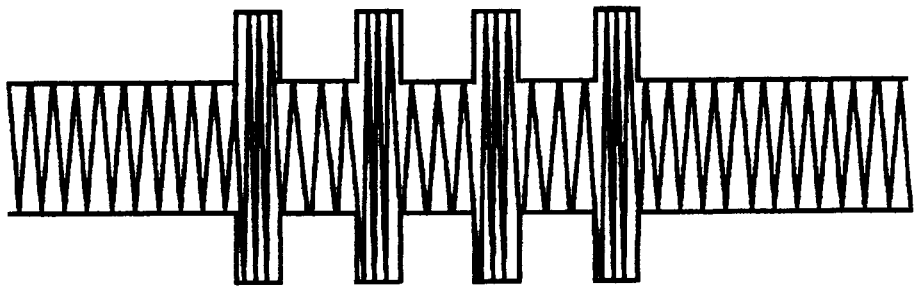
FIG. 5 shows change in the circuit voltage of the transceiver unit coupled by electromagnetic induction to the data carrier shown in FIG. 4.

FIG. 5 shows change in the circuit voltage of the transceiver unit 40 coupled by electromagnetic induction to the data carrier 3 shown in FIG. 4. As mentioned above, the output of the data carrier 3 has a pulse waveform having a prescribed period. As shown in FIG. 5, the circuit voltage generated in the transceiver unit 40 by the electromagnetic induction of the output of the data carrier 3 changes in the form of a pulse. In this way, the transceiver unit 40 precisely detects the resonance generated in the data carrier 3, that is, the presence of the data carrier 3, regardless of the speed of the vehicle 2. The duty ratio of this pulse depends on the on-off time of the switch 31.

Figure 6:
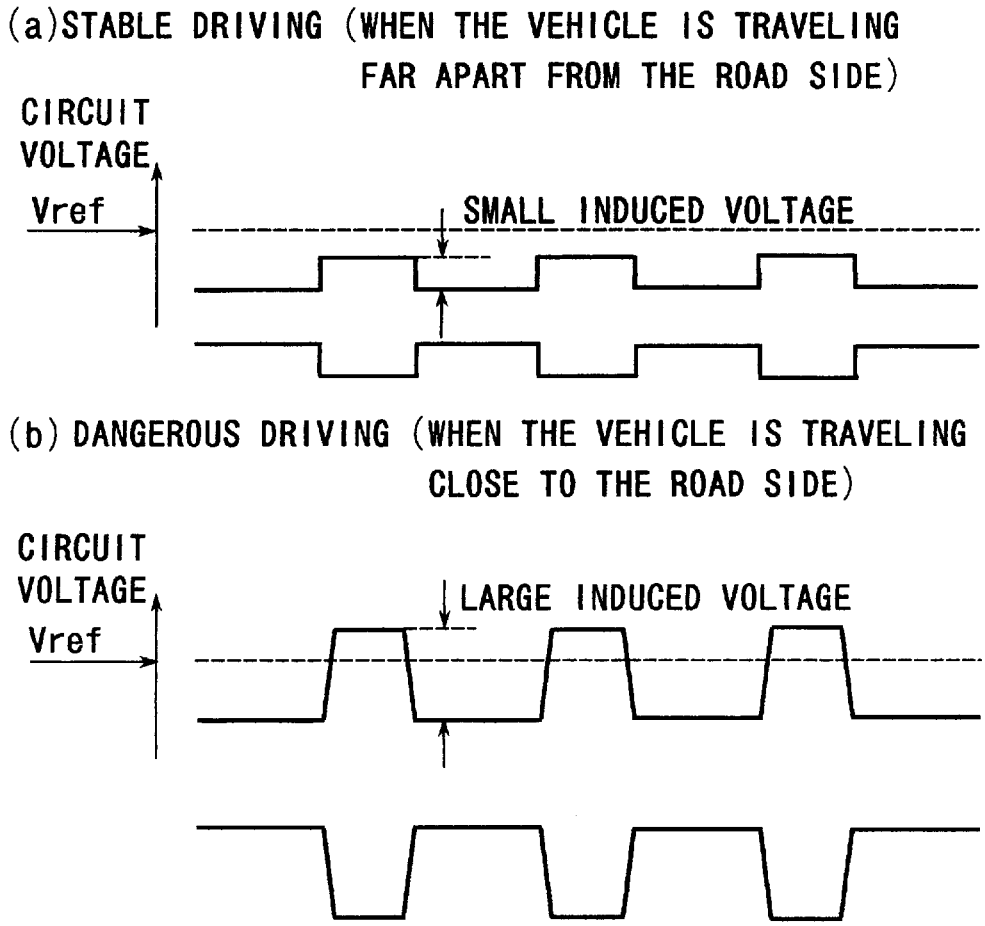
FIG. 6(*a*) shows the relation between the circuit voltage and a prescribe reference voltage Vref during stable driving.

FIG. 6(*a*) shows the relation between the circuit voltage of the transceiver unit 40 and the prescribed reference voltage Vref during stable driving (when the vehicle 2 is traveling far away from the roadside). FIG. 6(*b*) shows the relation between the circuit voltage of the transceiver unit 40 and the prescribed reference voltage Vref during dangerous driving (when the vehicle 2 is traveling close to the roadside). The data carrier 3 in this embodiment has a simple resonance circuit 30 shown in FIG. 2.

As shown in FIG. 6(*a*), during stable driving, that is, when the vehicle 2 is traveling sufficiently far away from the roadside, the induced voltage generated in the transceiver unit 40 of the on-vehicle transceiver 4 by the electromagnetic induction of the resonance circuit 30 of the data carrier 3 is small. Depending on the distance between the vehicle 2 and the data carrier 3, the induced voltage is not generated in some cases not shown in the drawing. In such cases, the detected circuit voltage is smaller than the reference voltage Vref. Therefore, the output of the differential amplifier 44 does not activate the annunciator 70 so that no alarm sound is generated.

On the other hand as shown in FIG. 6(*b*), during dangerous driving, that is, when the vehicle 2 is traveling close to the roadside, the voltage induced in the transceiver unit 40 of the on-vehicle transceiver 4 by the electromagnetic induction of the resonance circuit 30 of the data carrier 3, is large. Since the detected circuit voltage is larger than the reference voltage Vref, the output of the differential amplifier 44 activates the annunciator 70. The annunciator 70 generates an alarm sound. The driver then recognizes that the vehicle 2 is in danger of deviating from the roadway.

Figure 7:
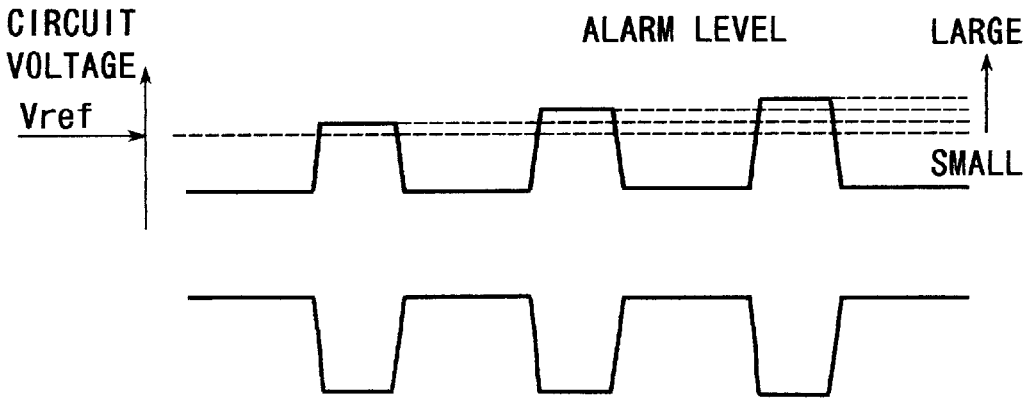
FIG. 7 shows the relation between the circuit voltage and the prescribe reference voltage Vref when the vehicle gradually approaches the data carrier.

FIG. 7 shows the relation between the circuit voltage and the prescribed reference voltage Vref when the vehicle 2 gradually approaches the data carrier 3. In this case, the data carrier 3 has a simple resonance circuit 30 shown in FIG. 2, and an induced voltage is generated in the transceiver unit 40 by the electromagnetic induction of the warning signal transmitted from the three data carriers 3 installed successively in the road.

As has been explained with reference to FIG. 6(*b*), the annunciator 70 generates an alarm sound when the circuit voltage input to the differential amplifier 44 exceeds the prescribed voltage Vref. As shown in FIG. 7, the voltage difference between the circuit voltage and the reference voltage Vref is increased monotonically from the first pulse to the last pulse. This means that the vehicle 2 is gradually approaching the data carriers 3, that is, the vehicle 2 is about to deviate from the roadway. In order to inform the driver that the vehicle 2 is in increasing danger of deviating from the roadway, the annunciator 70 according to the present embodiment generates an alarm sound whose level is proportional to the voltage difference between the circuit voltage and the reference voltage Vref. That is, when the voltage difference between the circuit voltage and the reference voltage Vref increases to a large value, the alarm sound increases to a level proportional to the increased voltage difference. On the other hand, when the voltage difference between the circuit voltage and the reference voltage Vref decreases to a small value, the alarm sound decreases to a level proportional to the decreased voltage difference. The driver is thus able to recognize that the vehicle 2 is about to deviate from the roadway when a loud alarm sound is generated.

Figure 8:
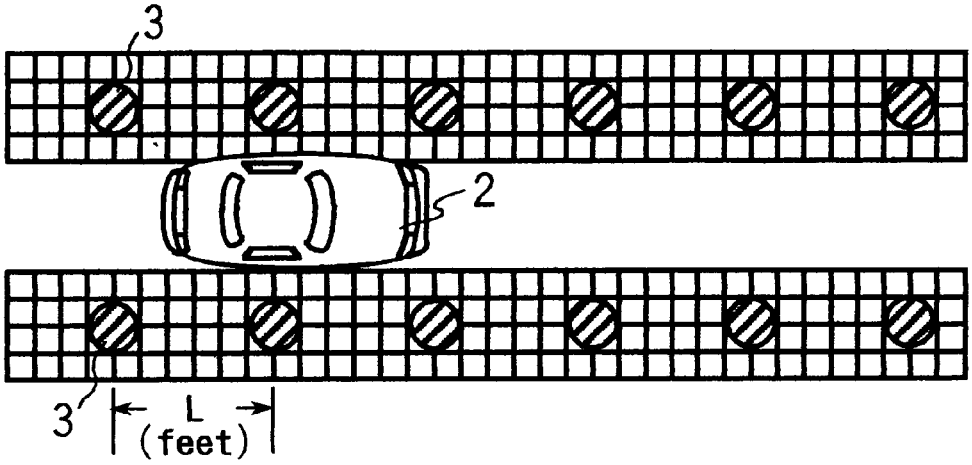
FIG. 8 shows an exemplary arrangement of data carriers according to the first embodiment of the present invention.

FIG. 8 shows an exemplary arrangement of data carriers 3 according to the first embodiment of the present invention. The data carriers 3 are embedded periodically on both sides of the roadway, with an equal separation distance L (feet). This separation distance is set to, for example, about 10 feet. This separation distance may be determined based on the type of the road such as a free way or a street. The data carriers 3 are embedded in the roadsides in this example. However, the data carriers 3 may be embedded in the roadway.

Figure 9:
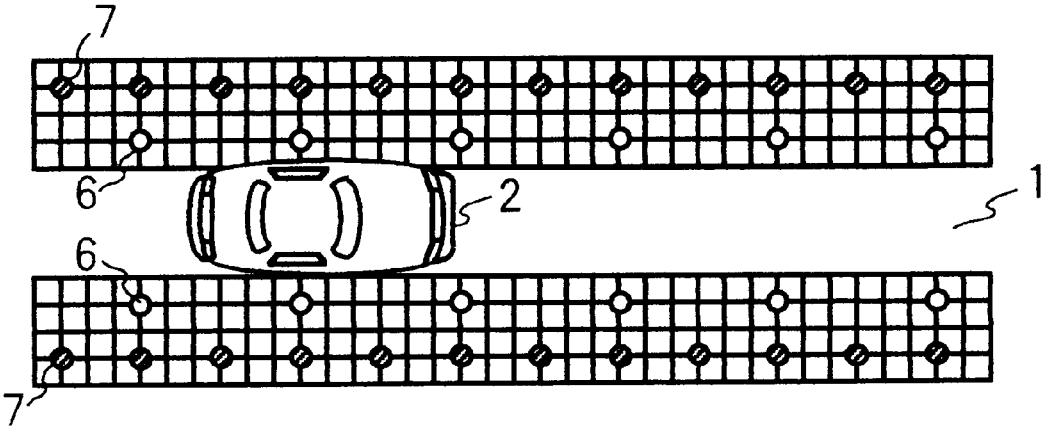
FIG. 9 shows an exemplary arrangement of data carriers according to the second embodiment of the present invention.

FIG. 9 shows an exemplary arrangement of data carriers 6 and data carriers 7 according to the second embodiment of the present invention. Two sequences of data carriers 6 and two sequences of data carriers 7 are embedded periodically in both roadside, along lines parallel to the traveling direction of the vehicle 2. Data carriers 6 are installed with a first prescribed separation distance to form a first row close to the roadway in each of the two roadsides. Data carriers 7 are installed with a second prescribed separation distance to form a second row farther away from the roadway than the first row, in each of the two roadsides. The first separation distance is set wider than the second separation distance. For example, the first separation distance and the second separation distance m are set to 14 feet and 7 feet, respectively.

Figure 10:
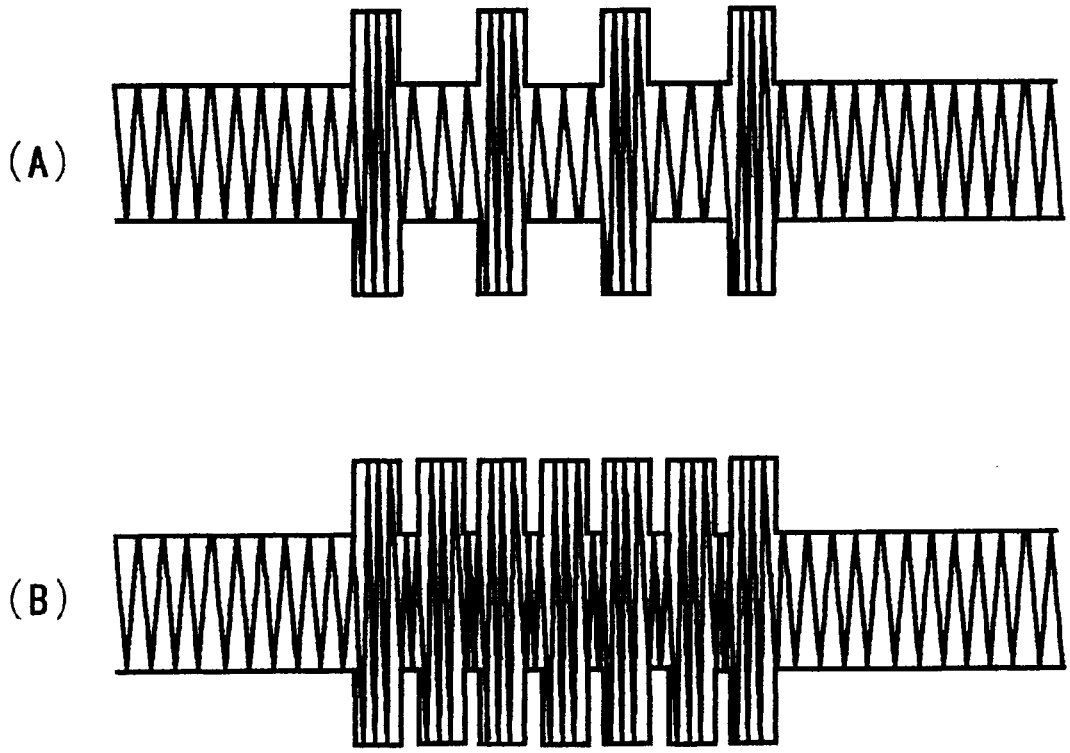
FIG. 10(*a*) shows a voltage change detected by the on-vehicle transceiver based on a warning signal transmitted from a data carrier embedded under the near road side of the highway.

FIG. 10(*a*) shows a circuit voltage detected by the transceiver unit 40 based on a warning signal transmitted from data carriers 6 installed in a strip of the roadside close to the roadway. When the vehicle 2 approaches the roadside, data carriers 6 transmit a warning signal which causes an induced voltage to be generated in the transceiver unit 40 of the on-vehicle transceiver 4.

FIG. 10(*b*) shows a circuit voltage detected by the transceiver unit 40 based on a warning signal transmitted from data carriers 7 installed in another strip of the roadsides farther away from the roadway, and more densely than the data carriers 6. When the vehicle 2 approaches very close to the roadsides, data carriers 7 transmit a warning signal which causes an induced voltage to be generated in the transceiver unit 40 of the on-vehicle transceiver 4.

Comparing FIG. 10(*a*) with FIG. 10(*b*), it is clear that the circuit voltage of the transceiver unit 40 changes corresponding to the separation distance between the data carriers 6 or 7. By installing the data carriers 6 and 7 in the manner shown in FIG. 9, the driver of the vehicle 2 is able to recognize that the vehicle 2 is approaching closer to the roadside when the period of the alarm sound becomes shorter.

Figure 11:
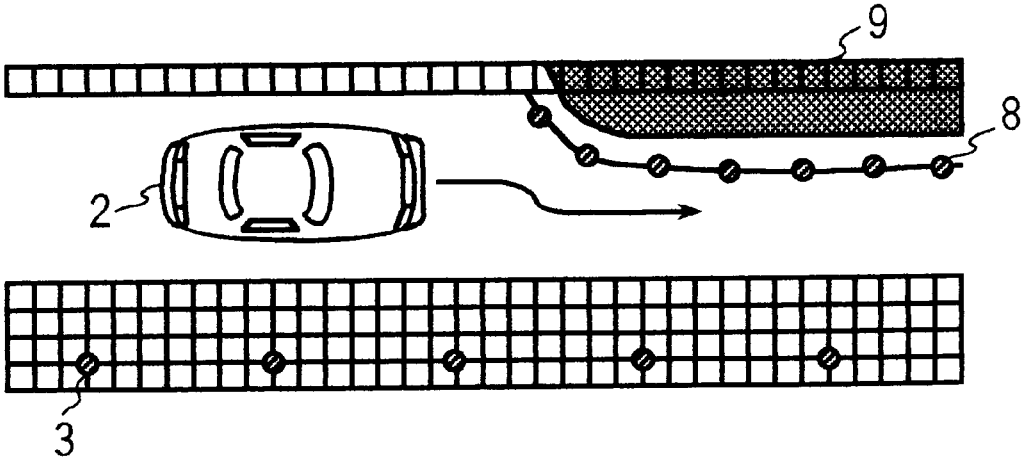
FIG. 11 shows an exemplary arrangement of data carriers according to the third embodiment of the present invention.

FIG. 11 shows an exemplary arrangement of data carriers 8 according to the third embodiment of the present invention. When an off limits area 9 is created on the roadway due to a road construction and maintenance work or an accident or a natural disaster, the above-described data carriers 8 are installed around the off limits area 9. For example, the data carriers 8 may be installed on construction and maintenance traffic control signs, or channeling devices, or flashing arrow panels, or the like. These data carriers 8 may be installed with a short separation distance of, for example, 5 feet. On hearing the alarm sound output from the annunciator 70 installed on the vehicle 2, the driver is able to identify the presence of the off limits area 9 and is guided safely through the work area in a safe direction. In this case, the data carriers 8 can be installed simply by installing tags at prescribed positions, which is very easy.

Thus, according to the resent invention, a roadway deviation prevention system capable of preventing vehicles from deviating from the roadway is provided.

So far, the present invention has been explained using embodiments. However, the range of technical applications of the present invention is not limited to these embodiments. Other variations and modifications of the above-described embodiments should be evident to those skilled in the art. Accordingly, it is intended that such alterations and modifications be included within the scope and spirit of the present invention as defined by the following claims.

What is claimed is:

1. An on-vehicle transceiver for transmitting to data carriers installed in a road a vehicle presence signal for indicating presence of a vehicle, comprising:

an oscillator unit for generating said vehicle presence signal;

a transceiver unit that transmits said vehicle presence signal to said data carriers and receives a warning signal for indicating presence of said data carriers that is transmitted from said data carriers based on said vehicle presence signal;

an annunciator that informs a driver of the vehicle of the presence of said data carriers; and a speed detector unit for detecting the speed of the vehicle;

wherein said annunciator is turned off when the detected speed is below a prescribed speed.

2. An on-vehicle transceiver as claimed in claim 1, wherein said annunciator informs the vehicle driver of the presence of said data carriers based on a voltage induced in said transceiver unit by an electromagnetic induction of said warning signal.

3. An on-vehicle transceiver as claimed in claim 2, wherein said annunciator outputs an alarm sound based on the induced voltage.

4. An on-vehicle transceiver as claimed in claim 3, further comprising a detector unit that detects a circuit voltage generated in said transceiver unit based on said induced voltage, wherein said annunciator outputs said alarm sound based on the detected circuit voltage.

5. An on-vehicle transceiver as claimed in claim 4, wherein:

said detector unit has a differential amplifier which amplifies and outputs a voltage difference between said detected circuit voltage and a prescribed reference voltage to said annunciator; and said annunciator outputs said alarm sound based on said voltage difference.

6. An on-vehicle transceiver as claimed in claim 5, wherein said annunciator outputs said alarm sound at a level that corresponds to said voltage difference.

7. An on-vehicle transceiver to be installed in a vehicle for communicating with data carriers installed in a road, along which the vehicle is traveling, comprising:

a transceiver unit that receives from said data carriers a warning signal for indicating presence of said data carriers;

an annunciator that informs the vehicle driver of the presence of said data carriers; and a speed detector unit for detecting a speed of the vehicle;

wherein said annunciator is turned off when the detected speed is below a prescribed speed.

8. An on-vehicle transceiver for transmitting to data carriers installed in a road a vehicle presence signal for indicating presence of a vehicle, comprising:

an oscillator unit for generating said vehicle presence signal;

a transmitter unit that transmits said vehicle presence signal to said data carriers;

a receiver unit that receives from said data carriers a warning signal for indicating presence of said data carriers;

an annunciator that informs a driver of the vehicle of the presence of said data carriers; and a speed detector unit for detecting a speed of the vehicle;

wherein said annunciator is turned off when the detected speed is below a prescribed speed.

9. A road system having data carriers embedded therein, the data carriers informing an on-vehicle transceiver unit installed on a vehicle that the vehicle is approaching close to at least one of said data carriers, each of said data carriers comprising a resonance circuit having a capacitor and a coil, wherein:

said resonance circuit resonates in response to a vehicle presence signal transmitted from the on-vehicle transceiver unit, when the vehicle approaches close to said data carrier, and emits a warning signal which indicates the presence of said data carrier; and said data carriers are embedded periodically in a roadside in a first row and a second row that are parallel to a traveling direction of the vehicle, the data carriers in said first row being arranged with a first prescribed separation distance, and the data carriers in said second row being arranged with a second prescribed separation distance that is shorter than said first prescribed separation distance.

10. A data carrier as claimed in claim 9, wherein said data carrier emits said warning signal based only on energy received by said resonance circuit with the vehicle presence signal.

11. A data carrier as claimed in claim 9, further comprising:

a storage capacitor for storing power generated when said resonance circuit receives said vehicle presence signal; and a switch which turns on or shuts off said resonance circuit based on the power stored in said storage capacitor.

12. A vehicle comprising an on-vehicle transceiver which transmits a vehicle presence signal for indicating presence of said vehicle to data carriers installed in a road, wherein said on-vehicle transceiver unit has:

an oscillator unit for generating said vehicle presence signal;

a transmitter unit that transmits said vehicle presence signal to said data carriers;

a receiver unit receiving a warning signal indicating presence of said data carriers, that is transmitted from said data carriers in response to said vehicle presence signal;

an annunciator which informs a driver of the vehicle of the presence of said data carriers; and a speed detector unit for detecting a speed of said vehicle;

wherein said annunciator is turned off when the detected speed is below a prescribed speed.

13. A vehicle as claimed in claim 12, wherein said on-vehicle transceiver is installed in a center portion of a width of said vehicle.

14. A vehicle as claimed in claim 12, wherein said on-vehicle transceiver is installed on a side portion of said vehicle.

15. A roadway deviation prevention system for preventing a vehicle from deviating from a roadway, comprising:

an on-vehicle transceiver that transmits a vehicle presence signal having a prescribed frequency; and data carriers, installed in a road, for emitting a warning signal resonating with said vehicle presence signal when the vehicle comes close to said data carriers, said data carriers being embedded periodically in a roadside along a first row and a second row that are parallel to a traveling direction of the vehicle, the data carriers in said first row being arranged with a first prescribed separation distance, and the data carriers in said second row being arranged with a second prescribed separation distance that is shorter than said first prescribed separation distance.

16. A roadway deviation prevention system as claimed in claim 15, wherein said on-vehicle transceiver has an annunciator that informs a driver of the vehicle of the presence of said data carriers, based on said warning signal.

17. A roadway deviation prevention system as claimed in claim 16, wherein said on-vehicle transceiver has a receiver unit for receiving said warning signal, and wherein said annunciator informs the vehicle driver of the presence of said data carriers based on voltage induced in said receiving unit by an electromagnetic induction of said warning signal.

18. A roadway deviation prevention system as claimed in claim 17, wherein said annunciator outputs an alarm sound based on the induced voltage.

19. A roadway deviation prevention system as claimed in claim 15, wherein said data carriers are periodically embedded in the road.

20. A roadway deviation prevention system for preventing a vehicle from deviating from a roadway, comprising:

data carriers, installed in a road, for emitting a warning signal to said vehicle, wherein said data carriers are periodically embedded in a roadside of the road along a first row and a second row that are parallel to a traveling direction of said vehicle, said data carriers in said first row being arranged with a first prescribed separation distance, and the data carriers in said second row being arranged with a second prescribed separation distance that is shorter than said first prescribed separation distance.

* * * * *